United States Patent [19]

Wells

[11] Patent Number: 4,542,694

[45] Date of Patent: Sep. 24, 1985

[54] OUT-OF-LINE UNDERWATER SAFING AND ARMING DEVICE AND METHOD THEREFOR

[75] Inventor: John L. Wells, San Carlos, Calif.

[73] Assignee: Quantic Industries, Inc., San Carlos, Calif.

[21] Appl. No.: 602,483

[22] Filed: Apr. 20, 1984

[51] Int. Cl.[4] ..... F42C 15/10; F42C 15/32; F42B 22/00

[52] U.S. Cl. ..... 102/229; 102/223; 102/406; 102/428

[58] Field of Search ..... 102/223, 222, 221, 229, 102/230, 406, 428, 414, 408

[56] References Cited

U.S. PATENT DOCUMENTS

| | | | |
|---|---|---|---|
| 2,953,092 | 9/1960 | Walker | 102/229 X |
| 3,532,057 | 10/1970 | Aubrey | 102/229 |
| 3,722,407 | 3/1973 | Fogal | 102/229 X |
| 3,889,598 | 6/1975 | Belsley | 102/229 |
| 4,158,334 | 6/1979 | Osburn | 102/229 X |
| 4,311,097 | 1/1982 | Backstein et al. | 102/223 X |
| 4,395,951 | 8/1983 | Hinely et al. | 102/229 X |

FOREIGN PATENT DOCUMENTS

| | | | |
|---|---|---|---|
| 2023777 | 1/1980 | United Kingdom | 102/223 |

*Primary Examiner*—David H. Brown

*Attorney, Agent, or Firm*—Flehr, Hohbach, Test, Albritton & Herbert

[57] ABSTRACT

An out-of-line water safing and arming device includes an out-of-line barrier assembly with an internal bore. When submerged, the bore fills with water which is entrapped by a hydrostatically-driven piston assembly to cause the barrier assembly to move to an in-line armed position. However, when the device is not utilized but is removed from the water or rises to the surface, the piston in reaction to the decrease hydrostatic pressure releases the hydraulic lock allowing the water to drain out.

7 Claims, 2 Drawing Figures

OUT-OF-LINE UNDERWATER SAFING AND ARMING DEVICE AND METHOD THEREFOR

BACKGROUND OF THE INVENTION

1. Field of the Invention

The present invention relates to out-of-line underwater safing and arming device which is armed at a predetermined ambient pressure when placed under water and when removed is automatically safed.

2. Description of Prior Art

Associated with almost every explosive device is a safing mechanism. Where such a device is for use under water such as, for example, shown in U.S. Pat. No. 4,395,951 with Hinely as inventor, the arming feature involves a submersion of the device in water—water then providing a "water column" which forms in effect a piston which reacts to pressure generated by an explosive actuator or squib. When so-fired, the Hinely patent device is then totally expended and releases some type of package in the water which, for example, might be used for mine sweeping. If not actuated, Hinely teaches that upon removal of the device from the water, water empties out of the device by means of gravity preventing any further actuation.

The Osburn U.S. Pat. No. 4,158,334 discloses an out-of-line safe/arm device used for initiating an explosion deep in a geothermal wall. It utilizes an air chamber and spring which when compressed enough by being lowered to a certain depth in the well lines up a detonator. If it is not fired but raised again, then the spring returns the device to an out-of-line safe position. Here there is no actual water arming but merely a response to the ambient pressure which would normally be supplied by a liquid medium. Thus, the Osburn device does not actually depend upon the use of a water column for arming. And, of course, Hinely while illustrating the use of a water column for use in arming an explosive device, since it does not have an in-line, out-of-line operational mode, but rather is a one-shot release device, its water column concept is not readily adaptable to the in-line, out-of-line technique of Osburn.

Thus, it is a general object of the present invention to provide an improved out-of-line underwater safing and arming device and method therefor.

SUMMARY OF THE INVENTION

An out-of-line underwater safing and arming device comprises a slidable barrier assembly having an internal bore and is slidable from an out-of-line position to an in-line position in which the device is armed. A first spring means biases the barrier assembly to the out-of-line position. A first piston means is coaxial with and slidable in the internal bore. Second spring means normally bias the first piston means out of engagement with the bore. The second piston means encloses a substantially air-tight cylinder and is connected and coaxial to and drives the first piston means. First aperture means expose the second piston means to ambient water pressure to cause it to compress entrapped air in the air tight cylinder and drive the first piston means toward the bore. Second aperture means allows water to enter the internal bore in the out-of-line position. The first piston means includes sealing means for mating with the bore to entrap this water in the bore.

From a method standpoint, there is provided a method of arming a device under water and safing it when removed from the water, the device having a normally out-of-line barrier which is the safe condition and is slidable to an in-line, armed condition. The barrier has an internal bore and the device has a first piston which is slidable in the bore. The method includes the steps of launching the device into the water and allowing water to enter and fill the bore. The increase in hydrostatic pressure then overcomes air and spring forces and moves the first piston towards the water filled bore. The first piston engages and hydraulically locks with the bore to entrap the water therein and causes the entrapped water to form an operating part of the first piston. As a unitary assembly, the first piston in combination with the barrier continues to move and responds to an increase in water pressure to move to an in-line position.

DESCRIPTION OF PREFERRED EMBODIMENT

Figure 1:
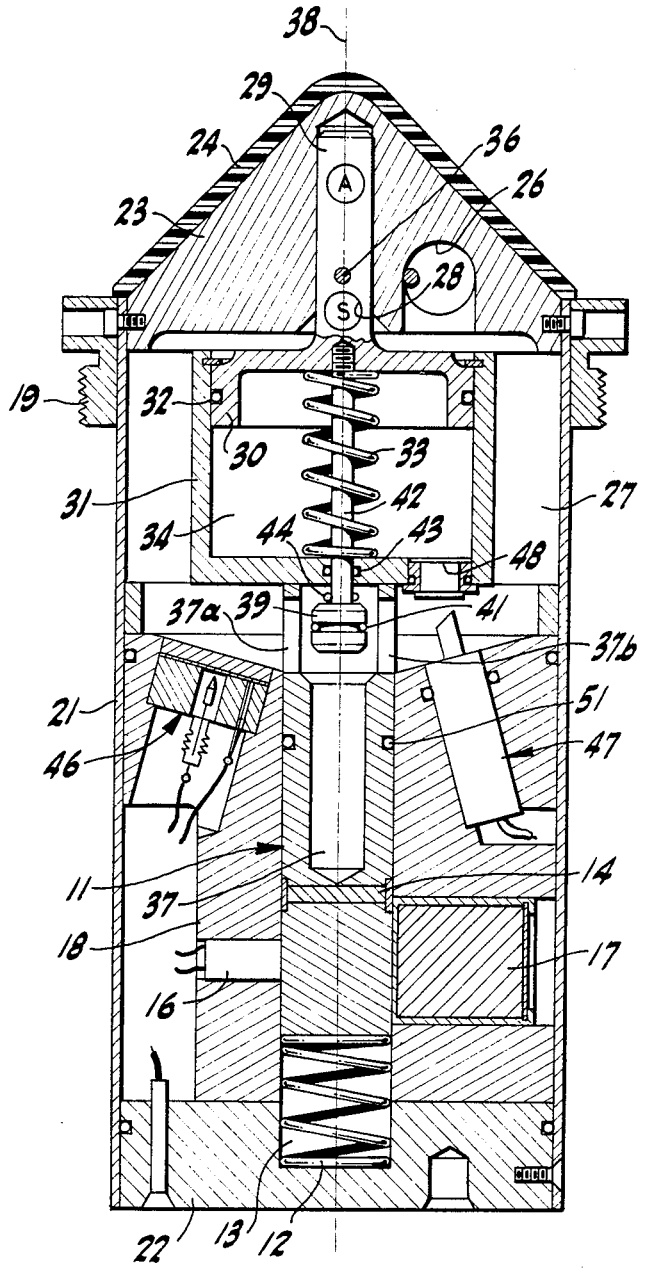
FIG. 1 is a cross-section of the device of the invention illustrating it in a safe, out-of-line position.

FIG. 1 illustrates the safing and arming device of the present invention in cross-section in its safe or out-of-line condition. That is, the barrier assembly 11 is biased upwardly by a spring 12 which is contained in an air-tight cavity 13. This keeps the explosive lead 14 "out-of-line" between the detonator 16 and booster charge 17. Thus, electrical actuation of detonator 16 would have no effect.

Figure 2:
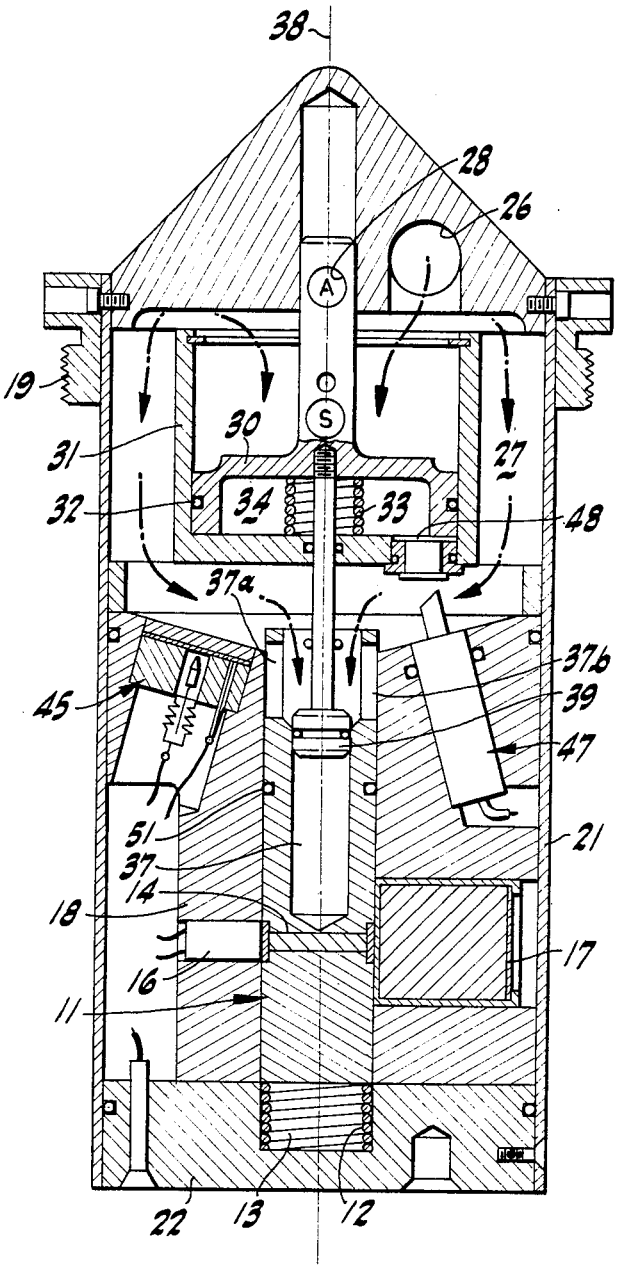
FIG. 2 is a cross-section of the invention illustrating it in an in-line, armed condition.

FIG. 2 illustrates the in-line or armed condition where the barrier assembly 11 which is cylindrical in shape and slidable within a cylindrical cavity in the frame 18 has been moved downward into an in-line, armed condition. Here when the detonator is fired it will explode the booster charge 17.

Referring back to FIG. 1, the entire device is screwed into and is part of some other device which is to be triggered by an explosive booster charge 17. Thus, the threaded ring 19 indicates that the entire device as illustrated is to be mounted on a larger device.

From an exterior standpoint, the safing and arming device as illustrated in FIG. 1 includes a cylindrical shell 21, a bottom cap 22, and a conical top cap 23 with a plastic cover 24. This cover is removed in use to expose water entry ports, one of which 26 is illustrated, which allows water to enter the cavity 27. A view window 28 indicates the position of the piston assembly within the device and is illustrated with an "S" showing for "safe" and appearing above that is the letter "A" for "armed"; that is, out-of-line and in-line. These letters occur on a shaft extension 29 of a piston 30 which encloses and is slidable in a substantially air-tight cylinder 31. Piston 30 includes an O-ring 32 to maintain such air-tight seal. A spring 33 normally biases the piston 30 to the safe position illustrated. Thus, in operation, the piston 30 moving downward in the cylinder 31 would compress the air in the air-tight cavity 34 and its spring 33. No movement, however, of this assembly can occur until the safing pin 36, which is a U-shaped pin, is removed from the shaft extension 29.

Barrier assembly 11 has an internal bore 37 which is coaxially with the axis of movement 38. Another piston 39 lies within this axis of movement and is slidable in internal bore 37 sealing therewith by means of an O-ring 41. It is connected to the piston 30 by a shaft 42 (around which is encircled spring 33) the shaft sliding in an O-ring bearing 43 which is at the center of the cylinder casing 31. The shaft 42 is also slidable on the roll pins 44. Thus, pistons 30 and 39 are moved together as a unitary assembly with the piston 30 driving the piston 39. When this occurs with a downward motion as illustrated in FIG. 1, the piston 39 will engage the internal bore 37. If the piston 39 were to inadvertently move downward into the bore 37 while only air is in the bore, the force which would tend to move barrier assembly 11 downward caused by the entrapped air would be totally overcome by the force of the spring 12 to maintain barrier assembly 11 securely in an out-of-line or safe position.

Other features of the device include a pressure switch 46 which is in series with the electrical leads to the detonator 16 preventing accidental actuation of the detonator unless a predetermined underwater depth is reached. Lastly, a pyro-actuator device 47 is aimed a rupturable membrane 48 to open the cavity 34 to the water.

The internal bore 37 and barrier assembly 11 includes the ports 37*a* and 37*b* in its upper enlarged portion which interface with the internal cavity 27 to allow entry of water when submerged. These entries in the bore itself must be sufficient in diameter, for example, 0.375 inches to ensure that the bore will fill with water without trapping air bubbles which would degrade operation.

In operation prior to launching into the water, the safing pin 36 is pulled from the unit and the plastic cover 24 removed as illustrated in FIG. 2. The water entry ports, one of which 26 is shown, are now open and when launched into the water, water enters the internal cavity 27 as illustrated by the arrows. Water also enters the internal bore 37. Since the device is in the position shown in FIG. 1, in addition the water pressure begins to overcome the air and spring forces in the air-tight cavity 34 and spring 33 to move piston 30 downwards. Passageways for water flow are designed to ensure that the internal bore 37 and the barrier assembly will be filled prior to initial movement of piston 30 due to the ambient hydrostatic pressure. Movement of piston 30, of course, moves the piston 39 towards the water-filled bore 37. Finally, when the O-ring seal 41 on the piston 39 enters the bore it will produce a hydraulic lock trapping the water in the bore. At this time, all of the force on top of the piston 30 is transferred directly to the spring 12 located at the bottom in the air-tight cavity 13. This is maintained air-tight by the O-ring 51 around the barrier 11. Thus, when this initial engagement occurs, the entrapped water in bore 37 in essence forms an operating part of the piston 30 and 39 and thus forms a unitary assembly which moves as a unit. Further increase in hydrostatic pressure due to the device going under water at greater depth, continues movement of barrier 11 until it is in an in-line position as indicated in FIG. 2. The force on piston 30, which is due to the hydrostatic pressure, overcomes the force of the entrapped air in cavity 34, the force of spring 33 and the force of spring 12. Thus, the armed condition is reached. It is visually indicated by the "A" appearing in the view window 28.

Finally, when the unit reaches a depth of 15 feet or greater, the pressure switch 46 closes to complete the electrical circuit to the detonator 16 and the device is fully armed. When a firing signal is supplied to the detonator (or detonators more commonly), they will cause the transfer leads to detonate which will in turn detonate the booster assembly 17. The output of the booster assembly will propagate through the wall 21 of the device and produce the detonation of the accompanying associated device.

However, rather than detonation, if dudding is desired at this depth, the pyro-actuator 47 is fired which ruptures the membranes 48 to allow pressurized water to flow into the air cavity 34 under the piston 30. This will neutralize the hydrostatic pressure on both the top and bottom of piston 30. When this occurs, the spring 33 located under the piston and the spring 12 located under the barrier will force the mechanism back into the out-of-line, safe position. A part of the force system to cause the device to operate properly is the diameter of the piston 30 exposed to the ambient water pressure is relatively large compared to the smaller diameter of piston 39 and bore 37.

However, if the device is not fired or actuated, the present invention also provides for safing of the device after being submerged if it is either removed from the water or accidentally rises to the surface. This decrease in hydrostatic pressure allows the various air and spring forces to cause the entire piston assemblies 30 and 39 to move into the safe position and disengage the hydraulic lock or seal of piston 39 with bore 37. Water then is allowed to drain out of the bore safing the device even in case of inadvertent actuation of piston 30 later.

In summary, the invention provides for arming only underwater at a predetermined depth by the use of the entrapped water column and at the same time returns the device to a safe condition when brought to the surface for later reuse. Thus, an improved out-of-line water safing and arming device has been provided.

I claim:

1. An out-of-line underwater safing and arming device comprising:

a slidable barrier assembly having an internal bore and slidable from an out-of-line, safe, position to an in-line position in which said device is armed;

first spring means biasing said barrier assembly to said out-of-line position;

first piston means coaxial with and slidable in said internal bore;

second spring means normally biasing said first piston means out of engagement with said bore;

second piston means, enclosing a substantially air-tight cylinder, connected and coaxial to and driving said first piston means;

first aperture means for exposing said second piston means to ambient water pressure to cause it to compress entrapped air in said air tight cylinder and drive said first piston means toward said bore;

second aperture means for allowing water to enter said internal bore in said out-of-line position, said first piston means including sealing means for mating with said bore to entrap said water in said bore.

2. A device as in claim 1 including dudding means for rupturing said air-tight cylinder to allow water to enter so that said first and second spring means return said barrier assembly to a safe position.

3. A device as in claim 1 where said first spring means has a greater biasing force than a forced caused by said first piston means entering said internal bore with only air entrapped therein.

4. A device as in claim 1 where said ambient pressure provides a sufficient force on said second piston means to drive said first piston means and said barrier toward an in-line position overcoming said biasing of said first spring means.

5. A device as in claim 4 where said second piston means has a significantly greater diameter than said first piston means.

6. A method for arming a device underwater and safing it when removed from the water having a normally out-of-line barrier, the safe condition, and slidable to an in-line, armed condition, the barrier having an internal bore, said device having a first piston which is slidable in said bore, said method comprising the following steps:

launching said device into said water;

allowing water to enter and fill said bore;

allowing the increase in hydrostatic pressure to overcome air and spring forces and move said first piston towards said water filled bore;

causing said first piston to engage and hydraulically lock with said bore to entrap said water therein and to cause said entrapped water to form an operating part of said first piston; continuing to move, in response to an increase in water pressure, said first piston and barrier as a unitary assembly to an in-line position.

7. A method as in claim 6 including the step of thereafter removing said device from the water and allowing said spring force to reverse the movement of said first piston to remove said hydraulic lock and allow water to drain out of said bore to thereby safe said device.

* * * * *